US010000302B2

(12) United States Patent
Kawoczka

(10) Patent No.: US 10,000,302 B2
(45) Date of Patent: Jun. 19, 2018

(54) METHOD OF FORMING A STACK OF COSMETIC PADS

(71) Applicant: Paul W. Kawoczka, Yardley, PA (US)

(72) Inventor: Paul W. Kawoczka, Yardley, PA (US)

( * ) Notice: Subject to any disclaimer, the term of this patent is extended or adjusted under 35 U.S.C. 154(b) by 408 days.

(21) Appl. No.: 14/947,603

(22) Filed: Nov. 20, 2015

(65) Prior Publication Data

US 2016/0152364 A1 Jun. 2, 2016

Related U.S. Application Data

(60) Provisional application No. 62/085,427, filed on Nov. 28, 2014.

(51) Int. Cl.

| | |
|---|---|
| ***B65B 35/50*** | (2006.01) |
| ***B65B 5/06*** | (2006.01) |
| ***B65B 63/00*** | (2006.01) |
| ***A45D 37/00*** | (2006.01) |
| ***B65B 25/00*** | (2006.01) |

(52) U.S. Cl.

CPC ..... *B65B 35/50* (2013.01); *A45D 37/00* (2013.01); *B65B 5/06* (2013.01); *B65B 25/00* (2013.01); *B65B 63/00* (2013.01); *A45D 2200/1036* (2013.01)

(58) Field of Classification Search

CPC ..... B65B 5/06; B65B 25/00; B65B 25/14; B65B 29/00; B65B 35/50; B65B 63/00; B65B 83/0894; A45D 37/00; A45D 2200/1036; B26F 1/384; B26F 1/3846; B26F 2001/4472; Y10T 83/0476; Y10T 83/2037; Y10T 83/2046; Y10T 83/4795; Y10T 83/4838; Y10T 83/9387; Y10T 83/9408

USPC ..... 53/431, 435, 447, 111 R, 520, 540, 532, 53/254; 83/331, 343, 346, 669, 678

See application file for complete search history.

(56) References Cited

U.S. PATENT DOCUMENTS 420,524 A * 2/1890 Wheeler ..... B26F 1/10 83/343
892,085 A * 6/1908 Rese ..... B26D 7/1818 83/346

(Continued)

FOREIGN PATENT DOCUMENTS

DE 102006020926 A1 * 11/2007 ..... B65D 83/0894
GB 438443 A * 11/1935 ..... B26F 1/384

*Primary Examiner* — Stephen F Gerrity

(74) *Attorney, Agent, or Firm* — LaMorte & Associates P.C.

(57) ABSTRACT

A system and method of forming a stack of pads, wherein each of the pads is rotationally askew with respect to its immediate neighbors in the stack. A cutting wheel is provided with cutting forms. The cutting forms are rotated by an offset angle, relative each adjacent cutting form. The cutting wheel is run over material to cut pads. Each of the pads sequentially cut is rotationally offset by the same offset angle as are the cutting forms. As the pads are cut, the pads are sequentially placed into a vertical stack. Each of the pads in the vertical stack is offset from immediately adjacent pads by the offset angle. The pads are formed into shapes that are mostly circular but have recessed areas that create salient points on the pads. The offset angles of each of the pads enables these salient points to be readily grasped.

17 Claims, 6 Drawing Sheets

(56) References Cited

U.S. PATENT DOCUMENTS 979,381 A * 12/1910 Conery, Jr. ..... A61Q 19/10 206/499
1,635,166 A * 7/1927 Albee ..... A43D 8/04 83/346
1,797,568 A * 3/1931 Dean ..... B26F 1/384 264/153
2,157,054 A * 5/1939 Gammeter ..... B26D 1/405 156/269
3,518,912 A * 7/1970 Winstead ..... B26D 1/00 83/344
4,362,623 A * 12/1982 Holopainen ..... B65D 71/00 206/499
4,480,772 A * 11/1984 Gerndt ..... A41D 27/10 83/343
4,595,502 A * 6/1986 Himmelsbach ..... A47J 31/08 206/499
4,874,112 A * 10/1989 Mulder et al. ..... A47F 1/065 222/1
5,738,212 A 4/1998 Pollard et al.
5,826,475 A * 10/1998 Mysliwiec ..... A61F 13/15723 83/669
5,894,927 A 4/1999 Bennett
D455,608 S * 4/2002 McWilliams ..... D7/400
7,594,461 B2 * 9/2009 Aichele et al. ..... B26D 7/22 83/344
8,657,115 B2 * 2/2014 Roempp et al. ..... A47K 10/421 53/431
9,611,085 B2 * 4/2017 Mangold et al. .. B65D 83/0894
2004/0216569 A1 * 11/2004 Mizutani et al. ..... B26F 1/384 83/13
2004/0245139 A1 * 12/2004 Mangold et al. .. B65D 83/0894 206/494
2004/0250363 A1 * 12/2004 Hsu ..... A45D 34/04 15/104.94
2005/0042414 A1 * 2/2005 Malay et al. ..... B26F 1/384 428/98
2006/0048616 A1 * 3/2006 Grenier et al. ..... B26D 7/20 83/659
2006/0191426 A1 * 8/2006 Timmerman et al. .. B26F 1/384 101/24
2007/0017840 A1 1/2007 Louis Dit Picard et al.
2008/0110723 A1 * 5/2008 Yan Ruz et al. ..... B65B 35/50 198/347.1
2012/0055305 A1 * 3/2012 Betti ..... B26F 1/384 83/436.3
2013/0089643 A1 * 4/2013 Chapman ..... B65D 85/76 426/119
2015/0305586 A1 * 10/2015 Musso ..... A47L 13/16 206/499

* cited by examiner

METHOD OF FORMING A STACK OF COSMETIC PADS

RELATED APPLICATIONS

This application claims priority of provisional patent application No. 62/085,427 filed Nov. 28, 2014.

BACKGROUND OF THE INVENTION

1. Field of the Invention

In general, the present invention relates to systems and methods of manufacturing pads of cloth and paper that are used to apply and remove cosmetics and skin care products. More particularly, the present invention relates to the shape of such pads and the manufacturing techniques used to produce and package such pads.

2. Prior Art Description

Pads that are made of cloth, cotton, paper and other non-woven materials are often used to apply and remove cosmetics and other skin care products. Typically such pads are formed to be either square or round. Both round pads and square pads are used for different purposes. For example, square pads are commonly used to remove nail polish. The salient points of a square pad are useful in reaching the recessed areas of the nail bed. Round pads are commonly preferred when removing or adding skin care products to rounded surfaces, such as eyelids and cheeks.

Pads are often packaged and sold in stacks. If the pads are dry, they are typically packaged in a simple bag. However, if the pads are moistened with some liquid, then the pads are typically packaged in jars or similar resealable containers that retain the moisturizing liquid. Pads are relatively thin. When they are stacked, it is often difficult to lift a single pad from the stack, especially if it is moistened. An individual square pad can typically be lifted from a stack by manipulating a salient corner of the square pad until it folds up away from the stack. However, due to their physical geometry, round pads have no salient points. It is therefore much more difficult to lift a single round pad away from a stack. It is especially difficult to lift a single round pad from a stack that is moistened and is positioned within the confines of a jar.

In the prior art, systems have been developed to try to assist a person grasp a thin pad that is in a stack. The prior art systems fall into three primary categories. The first category includes systems that use mechanical dispensers to separate a single pad from a stack of pads. Such prior art is exemplified by U.S. Pat. No. 5,894,927 to Bennett, entitled Dispenser For Applicator Pads. The problem with such systems is that complicated dispensers are expensive to manufacture. Furthermore, the use of a dispenser requires that pads be bought separately and transferred to the dispenser when the dispenser requires refilling. These disadvantages severely limit the commercial appeal of such systems.

The second category includes systems that alter the shape of the pads to make the pads easier to grip and remove from a stack. Such prior art systems are exemplified by U.S. Pat. No. 5,738,212 to Pollard, entitled Fibrous Pad And A Dispensing Package Therefore. The problem with such systems is that they require the shape and thickness of the pads to be altered. This complicates the manufacturing process and makes the pads more expensive to manufacture.

The third category includes systems that vary the orientation of each pad within the stack so that the pads always have a corner that extends freely from the stack. Such prior art systems are exemplified by U.S. Patent Application No. 2007/0017840 to Louis Dit Picard, entitled Stacking Of Fibrous Pads. The problem with such systems is that they require the pads to be either square or rectangular in shape. It also requires complex packaging equipment that rotates each of the pads as the pads are stacked atop one another. This complicated packaging equipment makes the pads more expensive to manufacture.

A need therefore exists for a system and method of creating round pads in such a manner that individual pads are easily grasped from a stack. A need also exists for a pad design that utilizes simple manufacturing and packaging techniques, yet can produce a stack of pads where each pad is oriented differently from the other pads that it contacts. These needs are met by the present invention as illustrated, described and claimed.

SUMMARY OF THE INVENTION

The present invention is a system and method of forming a stack of pads, wherein each of the pads is rotationally askew with respect to the other pads it contacts in the stack.

To form the pads, a cutting wheel is provided. The cutting wheel has a plurality of cutting forms disposed thereon. Each of the cutting forms has an identical shape. However, each of said cutting forms is rotated by an offset angle, relative each adjacent cutting form.

The cutting wheel is run over a length of material, wherein the cutting forms cut pads from the length of material. The pads each have the identical shape that is cut by the cutting forms. Each of the pads sequentially cut from the length of material is rotationally offset by the same offset angle as are the cutting forms.

As the pads are cut, the pads are sequentially placed into a vertical stack. The centers of the pads are vertically aligned. However, each of the pads in the vertical stack is offset from immediately adjacent pads by the offset angle. The pads are formed into shapes that are mostly circular but have recessed areas that create salient points on the pads. The offset angle of each of the pads enables these salient points to be readily grasped. As such, a single pad can be easily removed from the stack.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention pad can be embodied in many ways, only a few exemplary embodiments of the pad are illustrated. The illustrated embodiments are selected in order to set forth some of the best modes contemplated for the invention. The illustrated embodiments, however, are merely exemplary and should not be considered a limitation when interpreting the scope of the appended claims.

Figure 1:
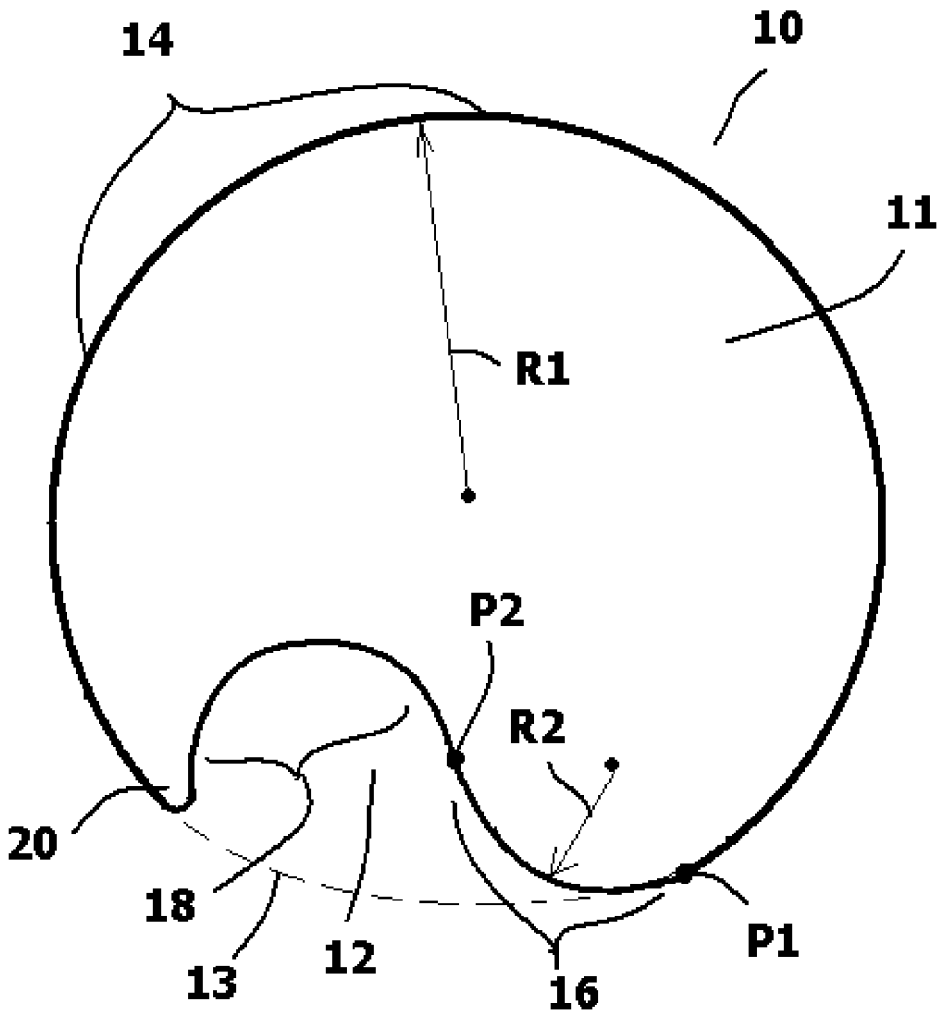
FIG. 1 is a top view of a first exemplary embodiment of a cut pad.

Referring to FIG. 1, a first exemplary embodiment of the present invention pad 10 is shown. As can be seen, the pad 10 is generally round. The pad 10 has a circular body 11 with a periphery that follows a circular path 13. The exception is a small relief 12 that is missing from the otherwise circular body 11. The relief 12 disrupts the circular path of the pad 10 along an arcuate angle of between forty five degrees and ninety degrees of what would otherwise be a 360 degree periphery of the circular path 13. Accordingly, the presence of the relief 12 disrupts between 12.5% and 25% of what is otherwise a circular periphery. The relief 12 has a generally paisley shape. Due to the shape of the relief 12, the periphery of the pad 10 has a complex shape with three primary sections. Those primary sections include the large convex section 14 having a first radius of curvature (R1), a small convex section 16 that has a second radius of curvature (R2), and a third concave section 18. The concave section 18 preferably has the same radius of curvature (R2) as the small convex section 16. The intersection of the third concave section 18 with the first large convex section 14 creates a salient point 20. The radius of curvature (R1) of the large convex section 14 is centered at a center point (CP).

The first large convex section 14 extends along the periphery of the pad 10 from the salient point 20 to a first transition point P1. The second small convex section 16 extends from the first transition point P1 to a second transition point P2. The third concave section 18 extends from the second transition point P2 back to the salient point 20.

Figure 2:
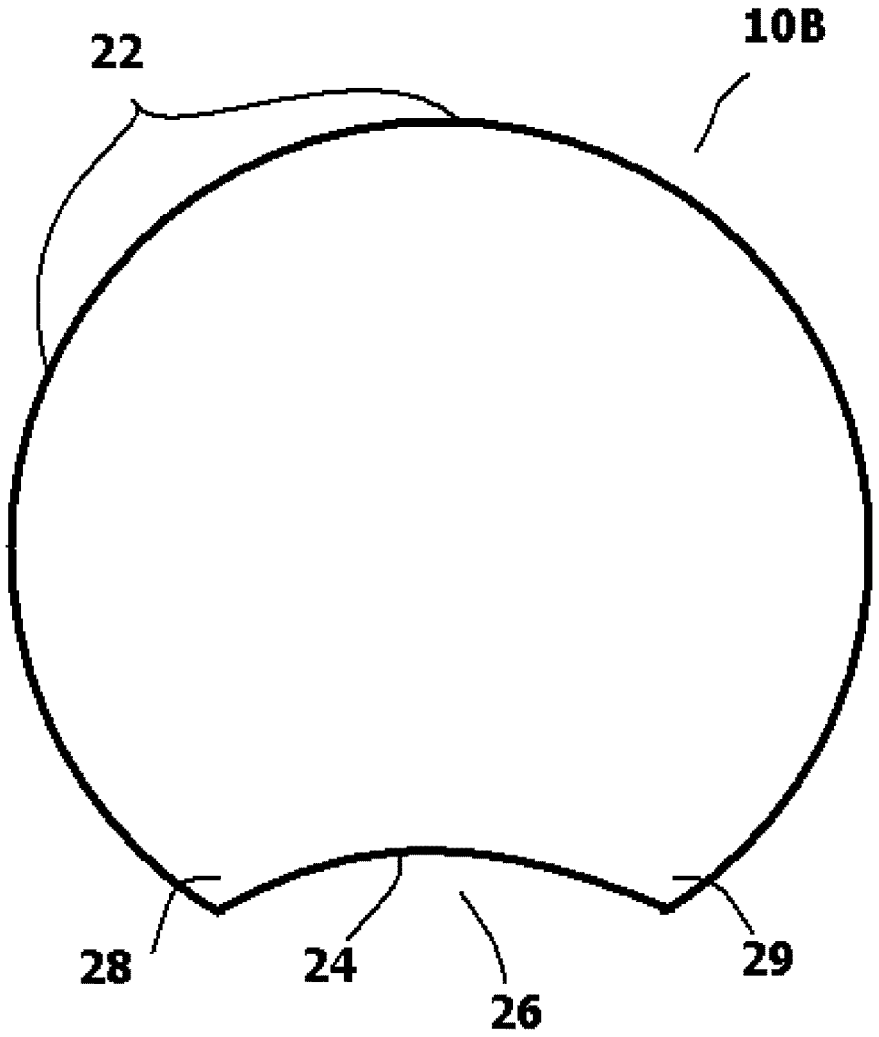
FIG. 2 is a top view of a second exemplary embodiment of a cut pad.
Figure 3:
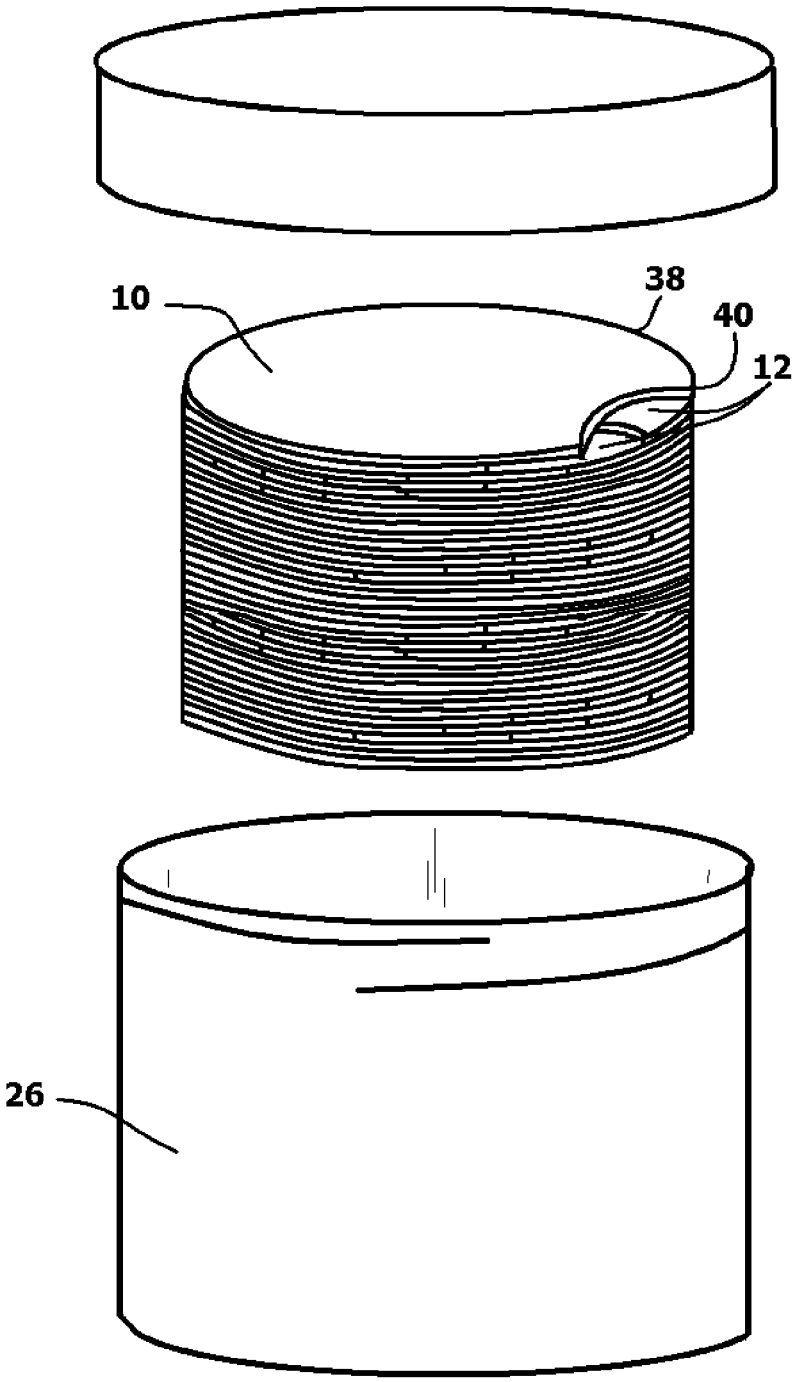
FIG. 3 is a top view of a third exemplary embodiment of a cut pad.

Alternate embodiments of the pad are shown in FIG. 2 and FIG. 3. In FIG. 2, a pad 10B is presented having a periphery with a large convex section 22 and a smaller concave section 24. The large convex section 22 follows a circular path along the periphery. The small concave section 24 is formed by a relief 26 being formed in the otherwise round pad 10B. The relief 26 and the resulting concave section 24 creates two salient points 28, 29 where the ends of the small concave section 24 transition back into the large convex section 22.

Referring to FIG. 3, the pad 10C is again circular with the exception of a relief 30 that is removed from the otherwise circular pad 10*c*. The relief 30 is complex in shape. The relief 30 has a concave section 32 and two smaller convex sections 34, 36. The smaller convex sections 34, 36 transition into the large convex section 38, outside of the relief 30. This creates two salient points 40 that are symmetrically formed at either end of the relief 30.

In all embodiments of the pad 10, 10B, 10C that are presented, the pad is circular in shape with the exception of a relief that is removed from the otherwise circular pad. The relief disrupts no more than a quarter of the pad's otherwise circular periphery. The relief also creates two salient points on the pad. The salient points can be symmetrically formed, as in FIG. 2 and FIG. 3, or can be asymmetrically formed, as in FIG. 1. In all embodiments the pad is flat and has a uniform thickness. The pad can be made of paper, cotton, cloth or any other material traditionally used for skin pads.

Figure 4:
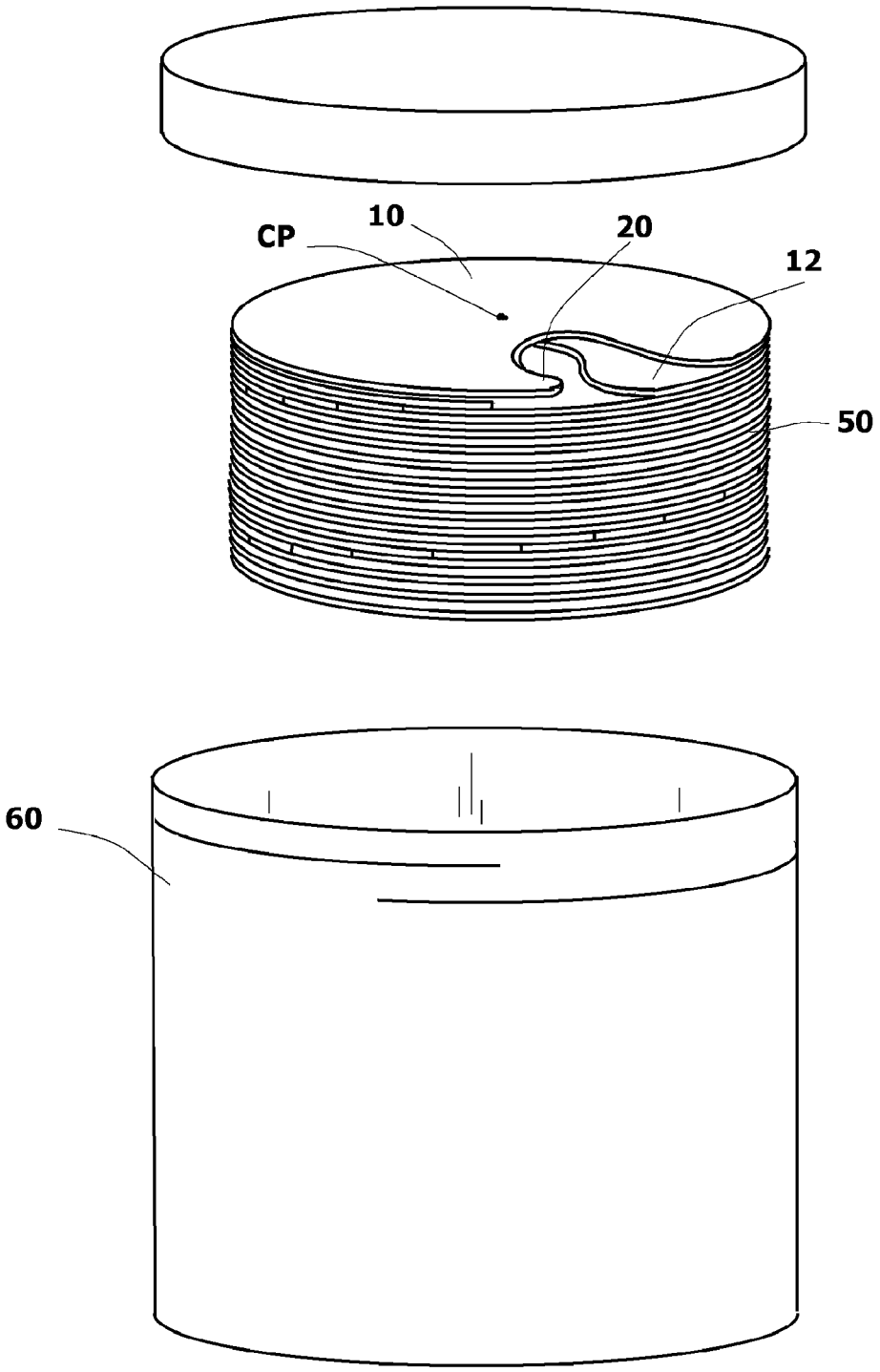
FIG. 4 is a perspective view of a stack of multiple pads.

Referring to FIG. 4 in conjunction with FIG. 1, it can be seen that pads 10 can be packaged into a stack 50 for sale. Within the stack 50, the pads 10 are vertically stacked atop one another. The pads 10 are stacked so that the center points (CP) of all the pads 10 are linearly aligned in the vertical. However, all of the pads 10 are not oriented about their center points (CP) in the same manner. Rather, each pad 10 is rotationally offset from the other pads it touches, both above and below, by a rotational angle. The rotational angle is always less than the angle of the otherwise circular periphery of the pad disrupted by the relief 12. As has been previously stated, the angle of the otherwise circular periphery of the pad 10 that is disrupted by the relief 12 is preferably between 12.5 degrees and 45 degrees. As such, the relief 12 disrupts between $1/4^{th}$ and $1/8^{th}$ of the periphery. The rotational angle used in forming the stack 50 is always a smaller number, preferably half the offset rotational angle. As such, if the relief 30 disrupts forty degrees of the otherwise circular pad, then the rotational angle used in the stack would be less than forty degrees, preferably twenty degrees. If the relief disrupts fifteen degrees of the periphery of the otherwise circular pad 10, then the rotational angle in the stack would be less than fifteen degrees; preferably seven and a half degrees.

Since the rotational angle used in the stack 50 is less than the angle along the periphery disrupted by the relief 12, then the reliefs 12 in the pads 10 partially overlap throughout the stack 50. In the shown embodiment, the relief 12 on each pad disrupts approximately 45 degrees along the length of the otherwise circular path 13 of the periphery. The reliefs 12 on subsequent pads 10 are offset rotationally by 22.5 degrees. The rotational offset of each of the reliefs 12 means that only part of one pad 10 will always overhang part of the relief 12 of the pad 10 below it. This provides an easy area to grasp the salient point 20 of the pad 10 because there is nothing immediately above or below the salient point 20. Rather, the salient point extends freely as a cantilever and is readily grasped. This makes individual pads 10 easier to grasp and remove from the stack 50.

Figure 5:
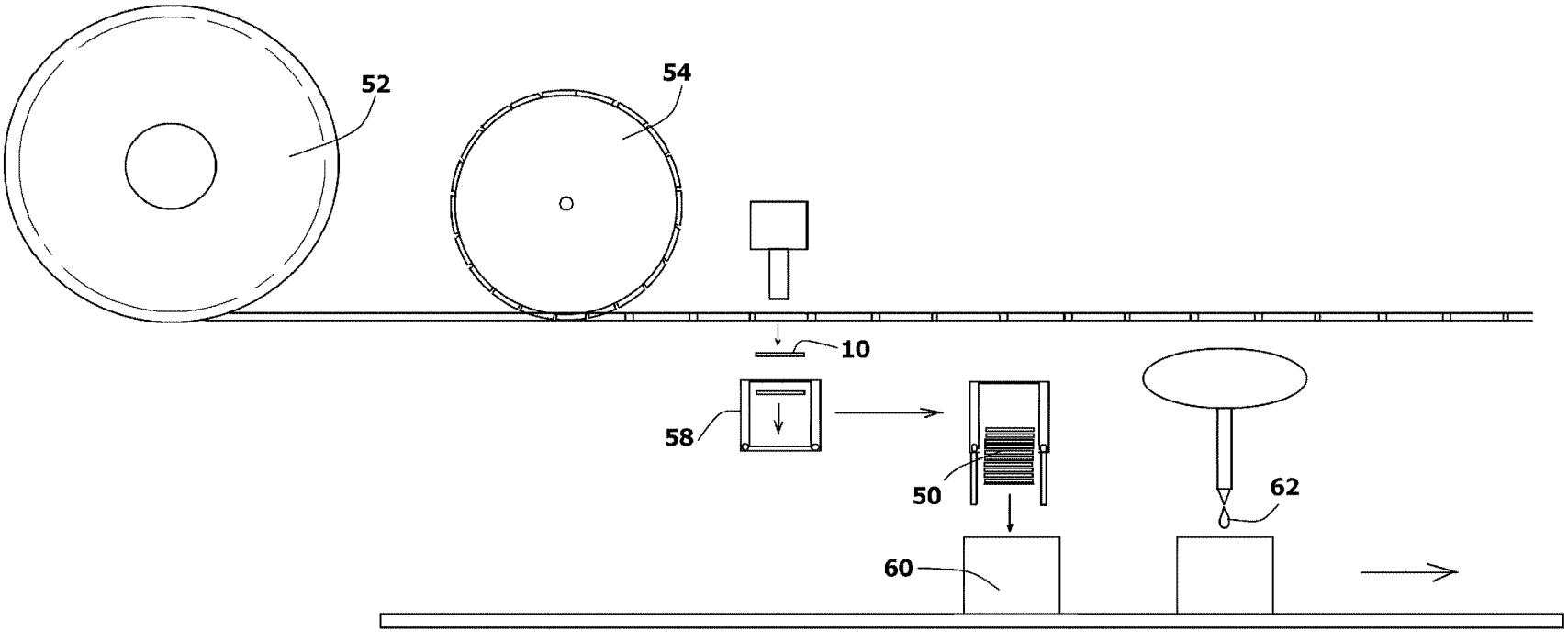
FIG. 5 is a diagram schematic showing a method of manufacture.
Figure 6:
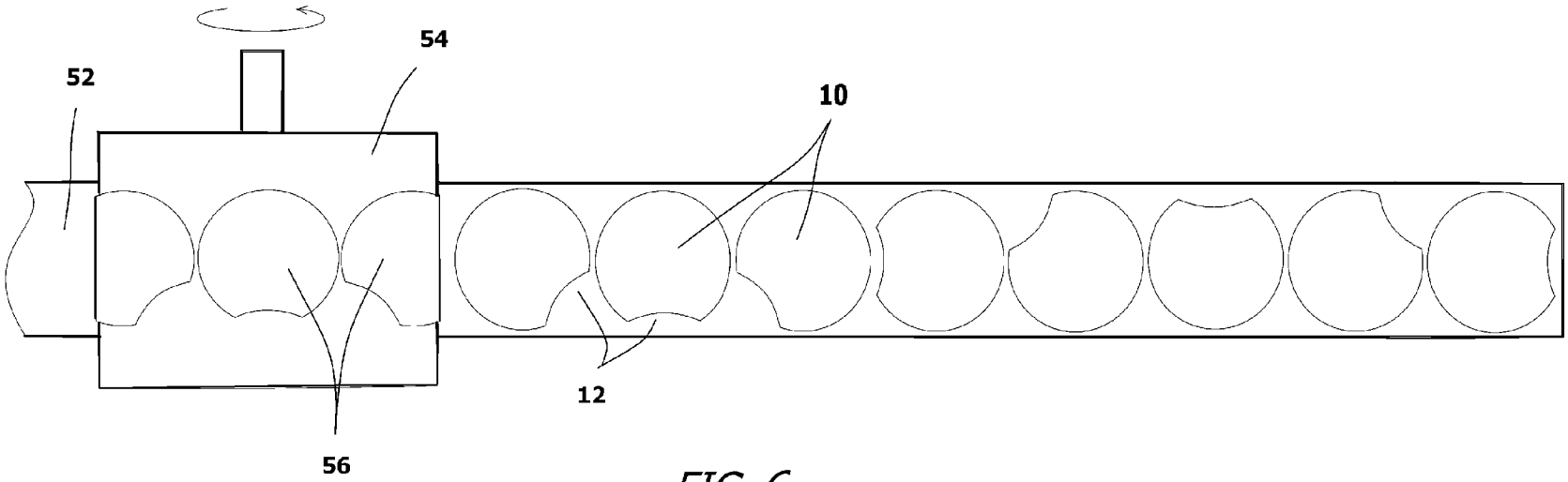
FIG. 6 shows a top view of a rolling cutter that is cutting pads from a length of material.

Referring to FIG. 5 and FIG. 6, in conjunction with FIG. 1 and FIG. 4, it will be understood that the pads 10 are cut from a larger roll of material 52. The roll of material 52 can be fabric, paper, or even processed cotton. As can be seen, the pads 10 are created by a rolling cutter 54. On the rolling cutter 54 are shaped cutters 56 that cut the roll of material into the configuration of the pads 10. Each shaped cutter 56 is rotationally offset from the other shaped cutters 56 it abuts. The offsets are progressive. As such, the shaped cutters 56 produce pads 10 with reliefs 12 that vary in position. After the pads 10 are cut, they are collected in a stacking bin 58 in the same order that they were cut. Since the reliefs 12 are in different positions on the pads 10, the pads 10 stack within the stacking bin 58 with the reliefs 12 in different positions. Once a predetermined number of pads 10 are cut and stacked in the stacking bin 58, the stack 50 is released into a jar or similar container 60. Liquid 62 is then added to the container 60 and the container 60 is sealed.

The rolling cutter 54 illustrated has only one row of shaped cutters 56. It will be understood that larger rolling cutters can be provided that contain multiple rows of shaped cutters. Such larger rolling cutters can be used to simultaneously cut multiple pads from larger sheets of material.

It will be understood that once the pads 10 are stored in the container 60 and are moistened with the liquid 62, the reliefs 12 on each pad 10 in the stack 50 is rotationally askew from the adjacent pads. This enables each individual pad 10 to be quickly and easily grasped and lifted out of the container 60.

It will be further understood that the embodiments of the present invention that are illustrated and described are merely exemplary and that a person skilled in the art can make many variations to those embodiments. All such embodiments are intended to be included within the scope of the present invention.

What is claimed is:

1. A method of forming a stack of pads, comprising the steps of:

providing a cutting wheel having a plurality of cutting forms disposed thereon, wherein each of said cutting forms has an identical shape, wherein each of said cutting forms is rotated by an offset angle, relative an adjacent cutting form;

running said cutting wheel over a length of material, wherein said cutting forms cut pads from said length of material, wherein said pads have said identical shape of said cutting forms and each of said pads sequentially cut from said length of material is rotationally offset by said offset angle;

stacking said pads into a vertical stack, wherein each of said pads in said stack is offset from immediately adjacent pads by said offset angle; and placing said vertical stack into a container.

2. The method according to claim 1, further including the step of adding liquid to said container.

3. The method according to claim 1, wherein said identical shape of said cutting forms produces pads, wherein each of said pads has a circular body and a relief formed into a section of said circular body, wherein said relief forms two salient points on said pad where said circular body transitions into said relief.

4. The method according to claim 3, wherein said two salient points are symmetrically formed on each of said pads.

5. The method according to claim 3, wherein said two salient points are asymmetrically formed on each of said pads.

6. The method according to claim 3, wherein said circular body has a periphery that follows a circular path and said section of said circular body taken by said relief disrupts said circular path of said periphery throughout an arcuate angle.

7. The method according to claim 6, wherein said arcuate angle is less than said offset angle.

8. The method according to claim 6, wherein said arcuate angle is half of said offset angle.

9. A method of forming a stack of pads, comprising the steps of:

providing a plurality of sequential cutters, wherein each of said sequential cutters cuts an identical shape, and wherein each of said sequential cutters is rotated by an offset angle, relative an adjacent one of said sequential cutters;

cutting a piece of material with said plurality of sequential cutters to form pads, wherein said pads have said identical shape and each of said pads sequentially cut from said piece of material is rotationally offset by said offset angle;

stacking said pads into a vertical stack, wherein each of said pads in said stack is offset from immediately adjacent pads by said offset angle.

10. The method according to claim 9, further including the step of placing said vertical stack into a container.

11. The method according to claim 10, further including the step of adding liquid to said container.

12. The method according to claim 10, wherein said identical shape of said pads includes a circular body and a relief formed into a section of said circular body, wherein said relief forms two salient points on said pad where said circular body transitions into said relief.

13. The method according to claim 12, wherein said two salient points are symmetrically formed on each of said pads.

14. The method according to claim 12, wherein said two salient points are asymmetrically formed on each of said pads.

15. The method according to claim 12, wherein said circular body has a periphery that follows a circular path and said section of said circular body taken by said relief disrupts said circular path of said periphery throughout an arcuate angle.

16. The method according to claim 15, wherein said arcuate angle is less than said offset angle.

17. The method according to claim 15, wherein said arcuate angle is half of said offset angle.

* * * * *